US006113431A

United States Patent [19]

Wong

[11] Patent Number: 6,113,431

[45] Date of Patent: Sep. 5, 2000

[54] FLAT F-PORT COAXIAL ELECTRICAL CONNECTOR

[76] Inventor: Shen-Chia Wong, No. 10, Lane 121, Li-Der Road, Peito District, Taipei, Taiwan

[21] Appl. No.: 09/205,570

[22] Filed: Dec. 4, 1998

[51] Int. Cl.[7] ..... H01R 25/00; H01R 27/02; H01R 31/00; H01R 33/88; H01R 33/90

[52] U.S. Cl. ..... 439/638

[58] Field of Search ..... 439/578, 574, 439/589, 638, 675, 750, 903

[56] References Cited

U.S. PATENT DOCUMENTS

| | | | |
|---|---|---|---|
| 3,694,793 | 9/1972 | Concleman | 439/358 |
| 5,498,175 | 3/1996 | Yeh et al. | 439/578 |
| 5,863,226 | 1/1999 | Lan et al. | 439/852 |

*Primary Examiner*—Lincoln Donovan
*Assistant Examiner*—Javaid Nasri
*Attorney, Agent, or Firm*—Dougherty & Troxell

[57] ABSTRACT

An improved cable connector having a connector body with threads on two ends and a hexagonal nut formed in between, with a flat sections lathe-fabricated at the outer extremities of the aforesaid threads and a containment hole extending lengthwise through the center of the connector body. Fitted inside the containment hole is a first insulator sleeve and a second insulator sleeve, and clipped in between the first and second insulator sleeves is a tubular contact component. The utilization of lathe fabrication allows for a smooth and even finish on all flat surfaces and enables the assembly of the first insulator sleeve, the second insulator sleeve, and tubular contact component to be conveniently inserted into the containment hole, while also preventing dislodging from the containment hole.

7 Claims, 7 Drawing Sheets

FLAT F-PORT COAXIAL ELECTRICAL CONNECTOR

BACKGROUND OF THE INVENTION (1) Field of the Invention

The invention herein relates to a cable connector, specifically referring to one in which the openings are fabricated utilizing a lathe to achieve mating surfaces of a smooth and even finish that enables a positive connection interface which prevents electromagnetic signal leakage when an F-type male connector is coupled to the connector of the invention herein.

(2) Description of the Prior Art

Referring to FIG. 1, a conventional cable connector is typically comprised of a connector body (10) having a plastic terminal (11) positioned inside and, furthermore, directly riveted to the opening (12), with the objective being the mounting and displacement prevention of the plastic terminal (11). However, the aforesaid type of fastening method leaves a protrusion at the area of riveting along with a depression produced by the impact of the riveting process, such that when an F-type male connector is coupled, the slight separation along the contact surfaces results in electromagnetic leakage from the cable television line, which is a source of interference to present day wireless communications signals.

Referring to FIG. 2, another kind of cable connector was developed to address the aforementioned shortcoming, wherein after the plastic terminal (13) is placed into the connector body (14), a washer (15) is fitted superficially thereon to enable the opening of the connector body (14) to have an even mating surface after riveting. However, since the aforesaid design failed to take into consideration the production problem of washer (15) dimension variance, separation tends to occur between the opening of the connector body (14) and the washer (15) which results in electromagnetic signal leakage. Furthermore, the aforesaid design involves higher production costs.

In view of the foregoing situations, the inventor of the invention herein conducted intensive research based on many years of experience gained through professional engagement in the manufacturing of related products, with continuous experimentation and improvement culminating in the development of the improved structure cable connector of the invention herein.

SUMMARY OF THE INVENTION

Therefore, the primary objective of the invention herein is to provide an improved cable connector of which the flat sections at the two extremities of the cable connector are lathe-fabricated to enable smooth and even mating surfaces.

To enable a further understanding of the innovative and technological content of the invention herein, refer to the detailed description of the invention and the accompanying brief description of the drawings appended below. Furthermore, the attached drawing are provided for purposes of reference and explanation, and shall not be construed as limitations applicable to the invention herein.

DETAILED DESCRIPTION OF THE INVENTION

Figure 1:
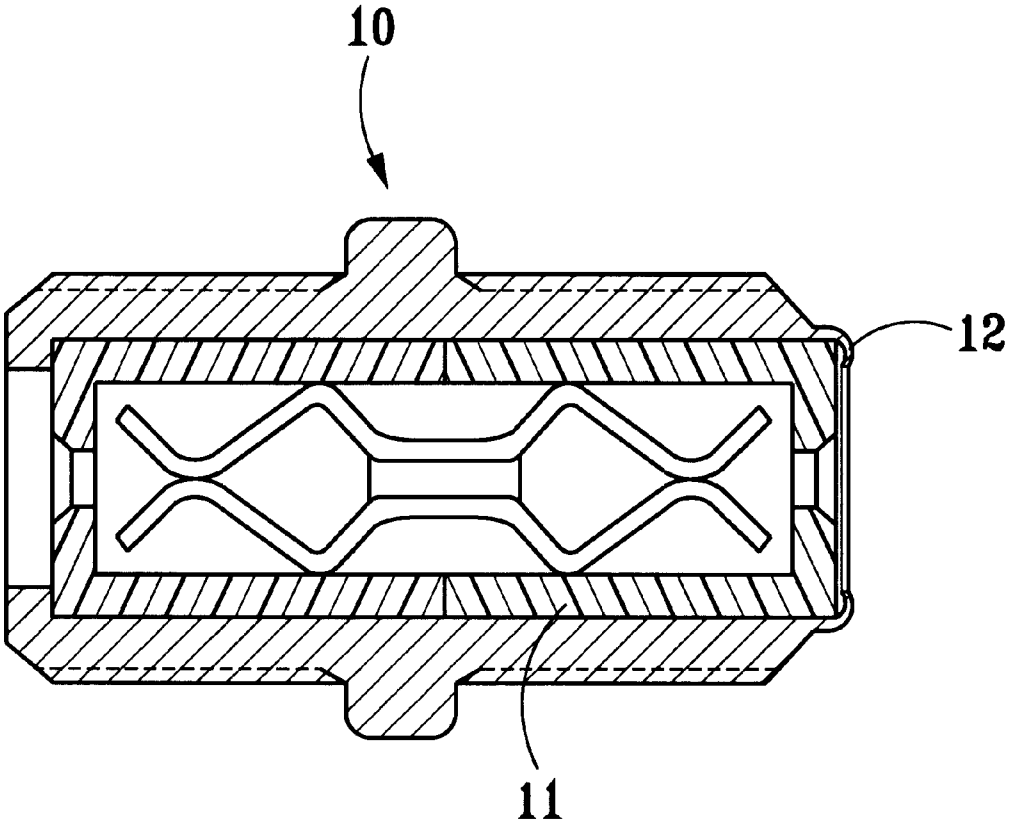
PRIOR ART FIG. 1
FIG. 1 is a cross-sectional drawing of a prior art cable connector.
Figure 2:
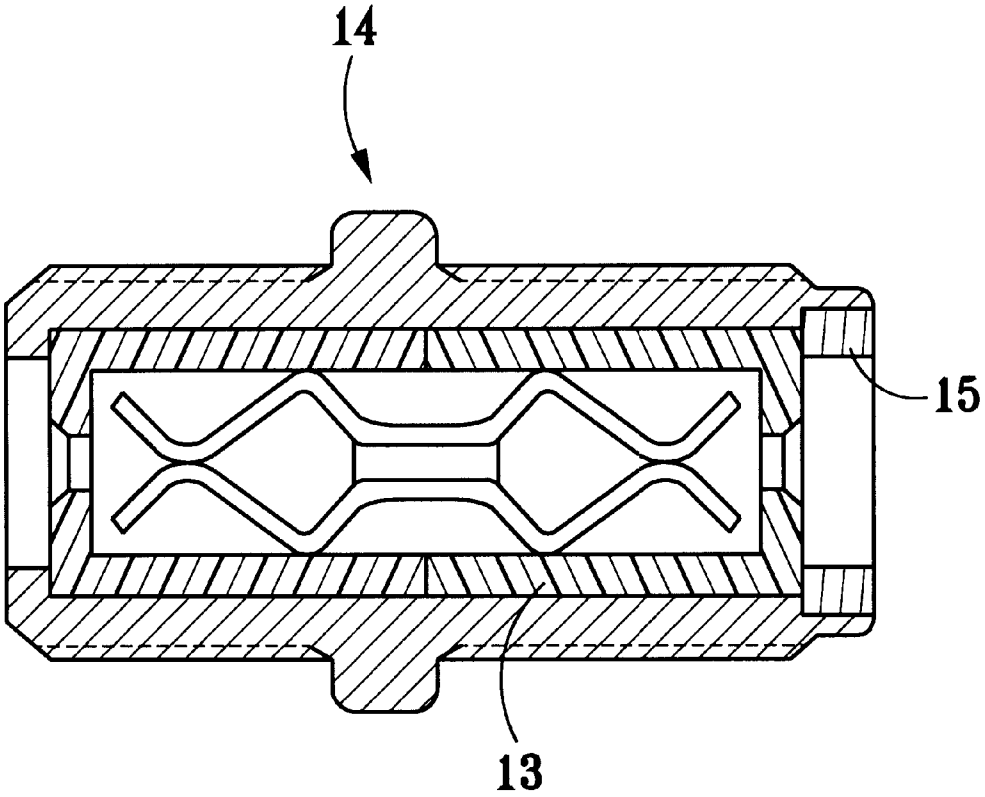
PRIOR ART FIG. 2
FIG. 2 is a cross-sectional drawing of another type of prior art cable connector.
Figure 3:
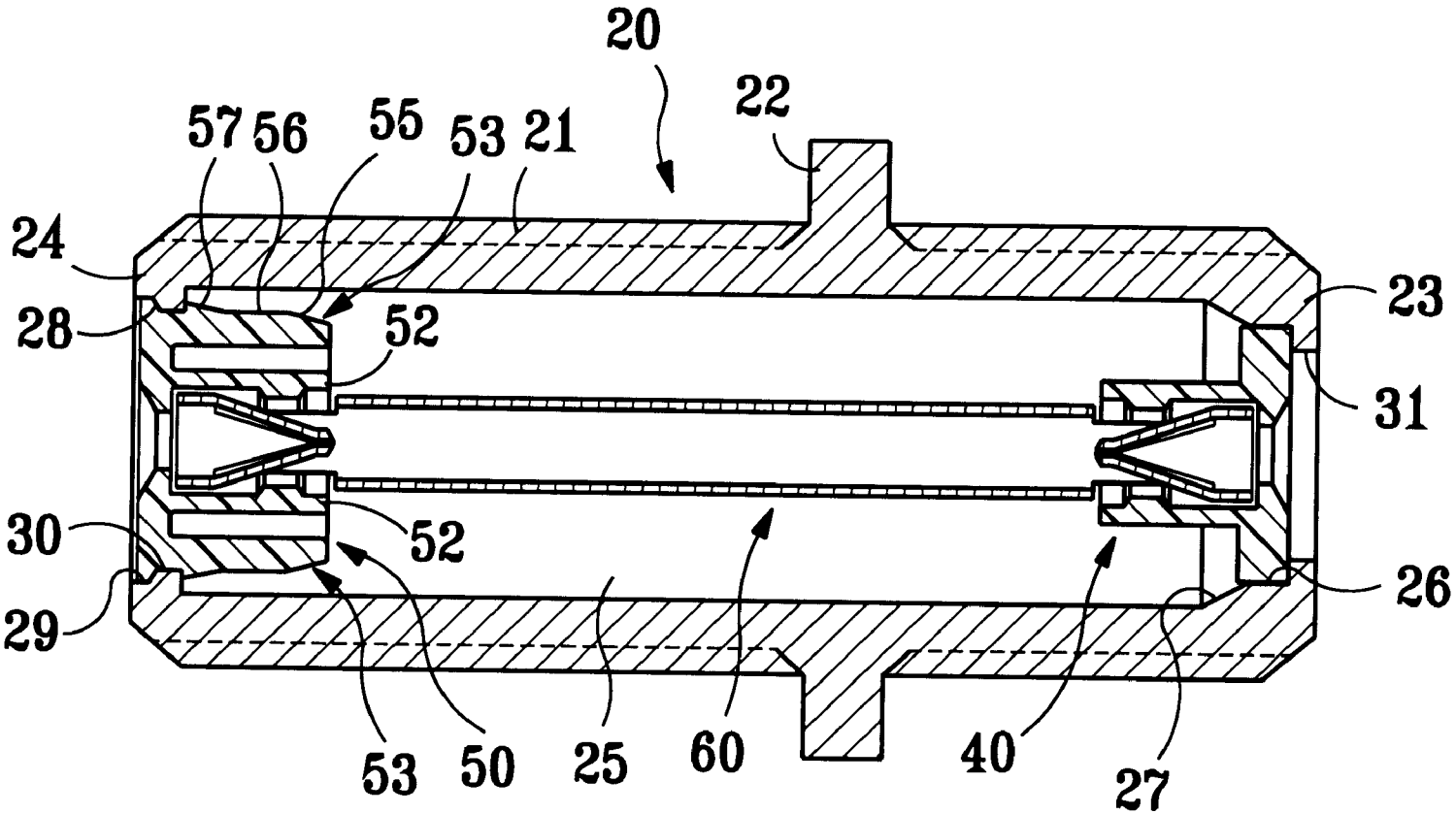
FIG. 3 is a cross-sectional drawing of the first embodiment of the invention herein.
Figure 4:
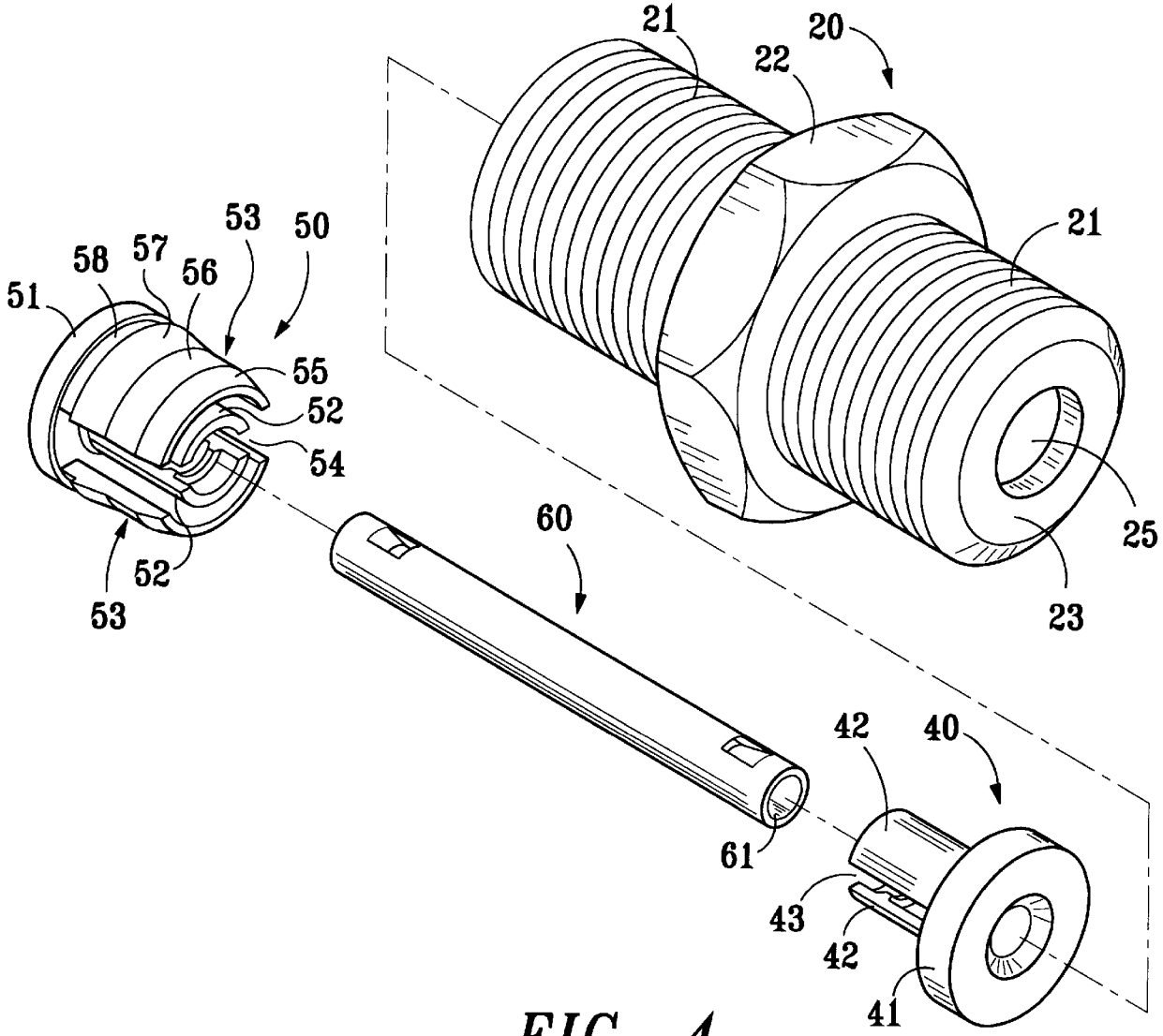
FIG. 4 is an exploded drawing of the connector body (20) in the first embodiment of the invention herein.
Figure 5:
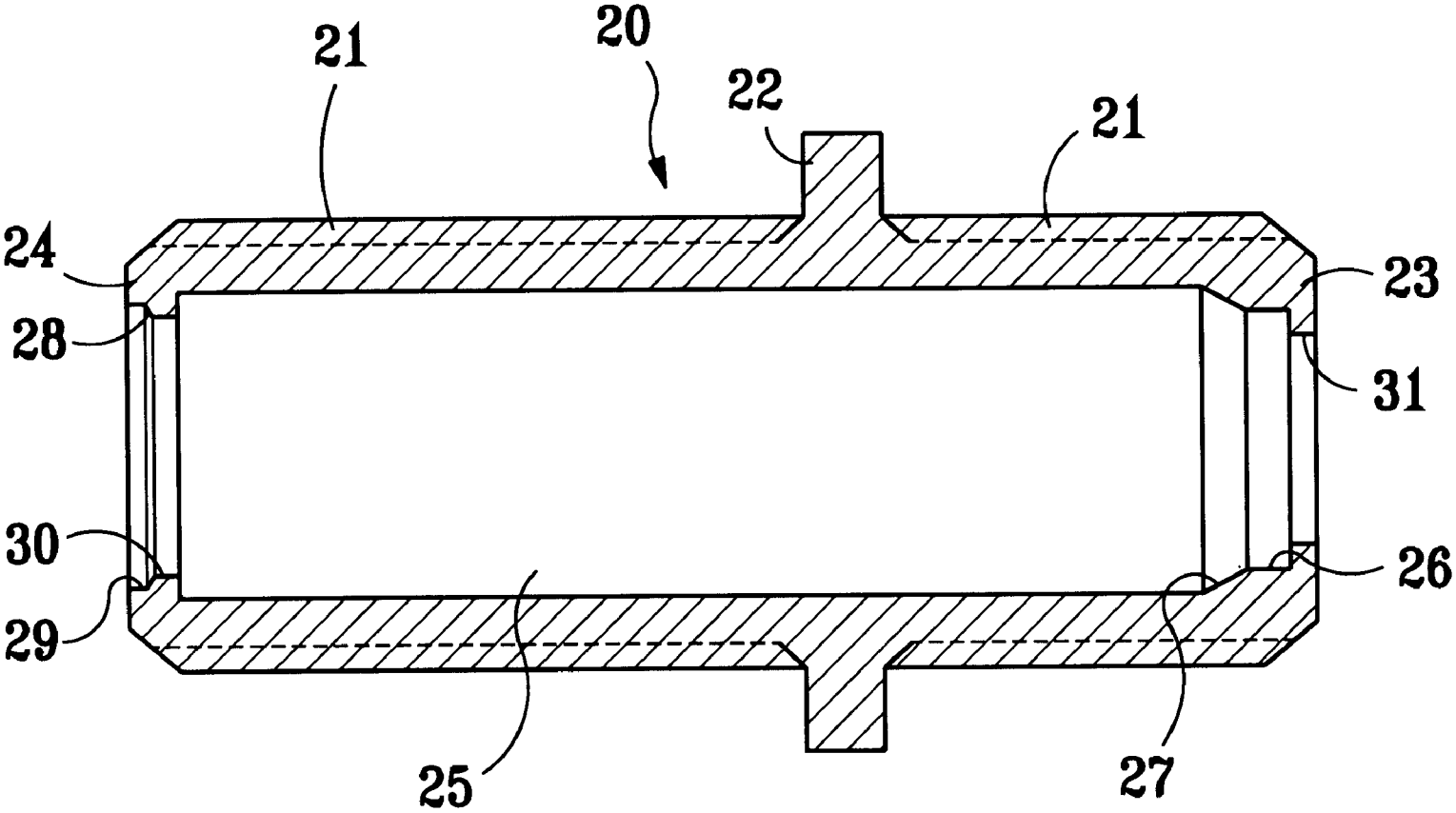
FIG. 5 is a cross-sectional drawing of the first embodiment of the invention herein.

Referring, to FIG. 3 and FIG. 4 the improved cable connector of the invention herein is comprised of a connector body (20) having threads (21) on the ends and a hexagonal nut (22) formed in between, with the flat sections (23) and (24) lathe-fabricated at the outer extremities of the aforesaid threads (21). The aforesaid that sections (23) and (24) consist of smooth and even surfaces. A containment hole (25) that extends lengthwise through the center of the connector body (20), and fitted inside the containment hole (25) at the flat sections (23) and (24) is the first insulator sleeve (40) and the second insulator sleeve (50), respectively, and positioned on the aforesaid first and second insulator sleeves (40) and (50) are spring clip sections (42) and (52), respectively. Hold in between the two spring clip sections (42) and (52) is a tubular contact component (60), with an insertion hole (61) at each of the two ends of the tubular contact component (60) that provides for the insertion and connection of an F-type male connector.

A stopper section (31) is formed by the interior walls of the aforesaid flat section (23), followed by the a holder section (26) of a larger diameter, which is followed contiguously by a beveled surface (27) that extends inward and is in conjoinment with the containment hole (25). Within the interior walls of the other flat section (24) is a groove (29) and extending inward from the aforesaid groove (29) is a small lip section (30) that is in conjoinment with the containment hole (25), with a beveled stopper section (28) located at the junction of the groove (29) and the small lip section (30).

A connection section (41) is positioned on the aforesaid first insulator sleeve (40) and attached to the surface at one end of the connection section (41) is a clip (42), having an expansion slot (43), which enables the clip (42) to be tightly fastened onto one end of the contact component (60).

A connection section (51) is positioned on the aforesaid second insulator sleeve (50) and on the center line of the connection section (51) is the clip (52) with an outer diameter section (53), and an expansion slot (54) in both the clip (52) and the outer diameter section (53) that enables the clip (52) and the outer diameter section (53) to have an elastic binding space so the clip (52) can be tightly fastened onto one end of the contact component (60). There is a beveled surface (55) along the exterior of the aforesaid outer diameter section (53), and contiguous to the end of the beveled surface (55) is a flat surface (56), followed by a beveled back stopper section (57), with a retaining groove (58) adjacent to the end of the aforesaid beveled back stopper section (57).

The assembly of the first insulator sleeve (40), the second insulator sleeve (50), and the contact component (60) are installed inside the containment hole (25), with the connection section (41 ) of the first insulator sleeve (40) inserted into the holder (26) with an end against the stopper section (31) such that further movement is not possible. The outer diameter section (53) of the aforesaid second insulator sleeve (50) has an elastic space, such that the beveled surface (55) is smoothly guided along the beveled section (28) when inserted and, furthermore, in a state of compression, enables the lip section (30) to become inserted into the retaining groove (58). With the lip section (30) held in place by the back stopper section (57), the assembly of the first insulator sleeve (40), the second insulator sleeve (50), and the contact component (60) cannot be dislodged out of the containment hole (25).

As such, the flat surfaces of the invention herein can be lathe-fabricated to achieve a smooth and even finish of the facets, enabling, a positive connection interface that prevents electromagnetic signal leakage when an F-type male connector is coupled onto the end of the invention herein.

Figure 6:
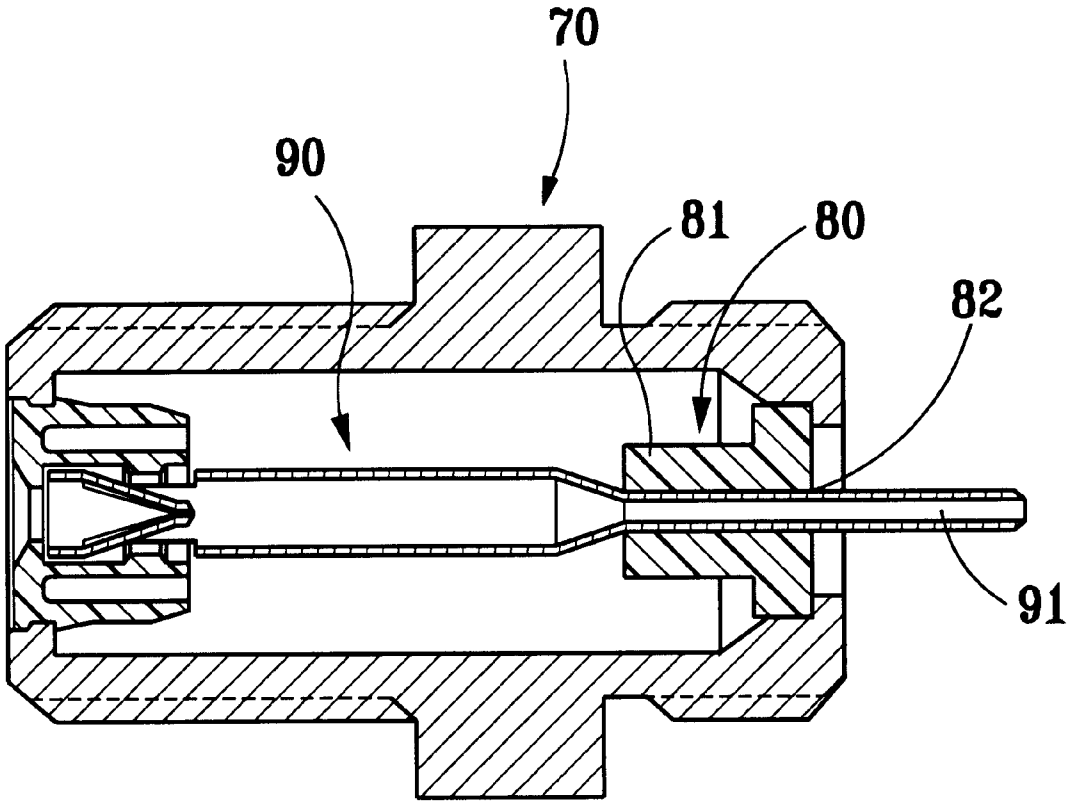
FIG. 6 is a cross-sectional drawing of the second embodiment of the invention herein.
Figure 7:
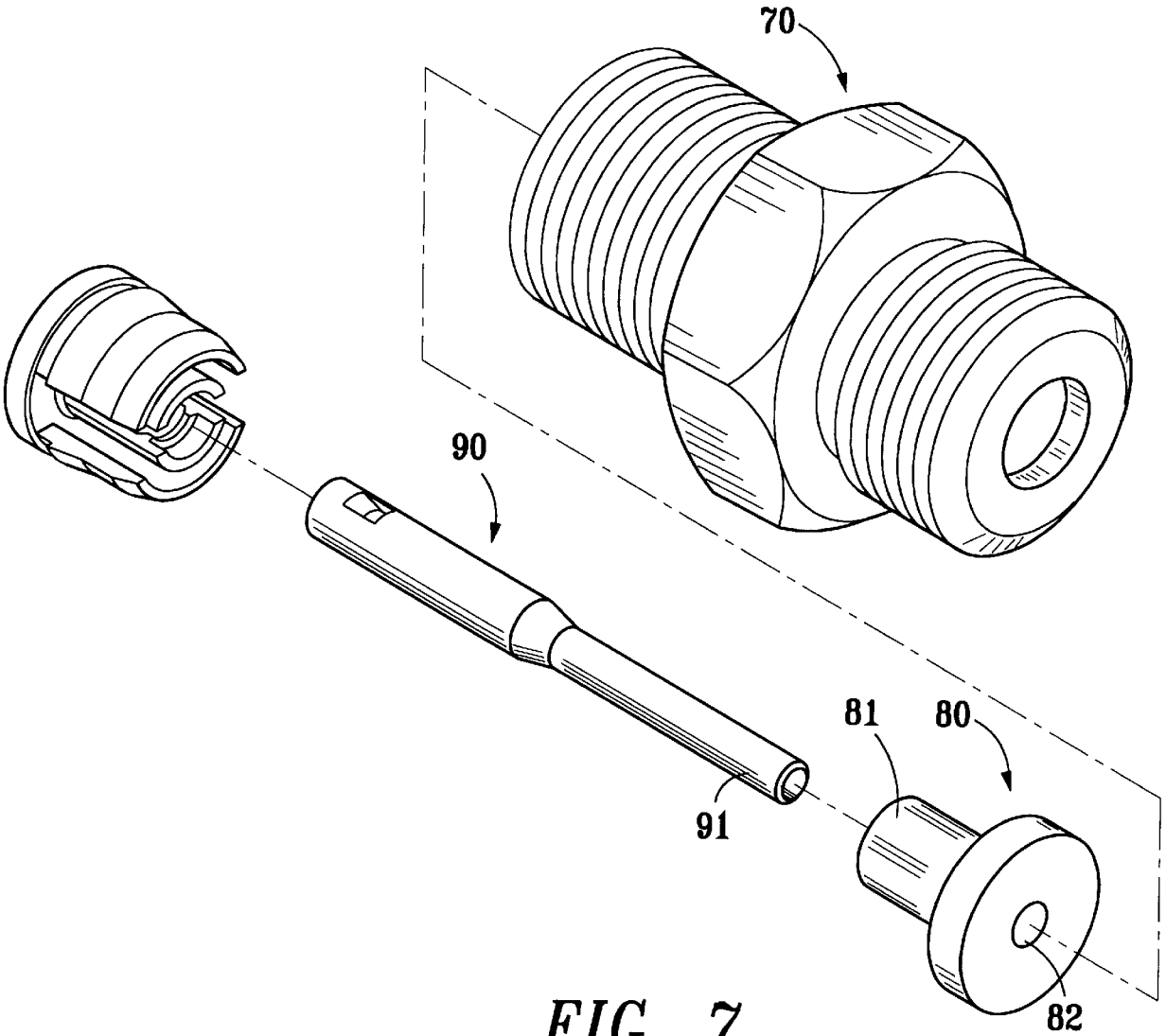
FIG. 7 is an exploded drawing of the second embodiment of the invention herein.

Referring to FIG. 6 and FIG. 7, the second embodiment of the invention herein is comprised of a single connector (70), wherein the counterparts of first insulator sleeve (40) and the contact component (60) in the first embodiment of the invention herein are of slightly modified design. In the aforesaid second embodiment, the first insulator component (80) has a seal section (81) and there is a center hole (82) through the seal section (81). The contact component (90) has a reduction end (91) that in addition to allowing the insertion of the reduced end (91) through the center hole (82) also enables the exposure of the outer end and the capability of connecting to a main circuit board.

As such, the flat surfaces of the invention herein can be lathe-fabricated to achieve a smooth and even finish of the facets, enabling a positive connection interface that prevents electromagnetic signal leakage when an F-type male connector is coupled onto the end of the invention herein.

The aforementioned embodiments were utilized to provide a detailed description of the objectives, innovations, and functions of the invention herein and while persons skilled in the technology may he capable of adapting and modifying the embodiments of the invention herein based on the foregoing description, this shall not constitute a departure from the spirit and scope of the invention herein and, therefore, the scope of the patent rights protecting the invention herein shall be qualified by the claims described below.

What is claimed is:

1. A flat F-port coaxial electrical connector comprising:

a) a connector body having threaded opposite end portions with a hexagonal nut between the end portions, the connector body having a lengthwise containment hole, a stopper section on a first end of the connector body extending inwardly of the containment hole and bounding a first end opening, a second end of the connector body having a lip extending inwardly of the containment hole, the lip bounding a second end opening larger than the first end opening, the first and second end portions each having an annular, flat mating surface thereon, the lip being located inwardly of the flat mating surface on the second end portion;

b) a tubular contact located in the containment hole;

c) a first insulator sleeve mounted on the tubular contact having a first connection section and a first clip section extending therefrom, the connection section sized so as to fit through the second end opening and to bear against the stopper section; and, d) a second insulator sleeve mounted on the tubular contact, the second insulator sleeve having a second connection section and a second clip section extending therefrom, the second connection section having a first longitudinal expansion slot, the second insulator sleeve having a circumferential retaining groove configured to engage the lip, whereby the first insulator sleeve attached to the tubular contact is inserted into the containment hole through the second end opening and placed into contact with the stopper section, the retaining groove engaging the lip to retain the tubular contact, the first insulator sleeve and the second insulator sleeve in the containment hole of the connector body such that the second insulator sleeve has a sleeve end located outwardly of the lip.

2. The flat F-port coaxial connector of claim 1 wherein the second clip section is located within the second connection section, the second clip section having a second longitudinal expansion slot.

3. The flat F-port coaxial connector of claim 2 wherein the first clip section has a third longitudinal expansion slot.

4. The flat F-port coaxial connector of claim 1 further comprising:

a) a cylindrical surface extending from the stopper section; and, b) a first beveled surface connecting the cylindrical surface to a surface bounding the longitudinal containment hole.

5. The flat F-port coaxial connector of claim 4 further comprising a second beveled surface on the lip, the second beveled surface facing outwardly from the longitudinal containment hole.

6. The flat F-port coaxial connector of claim 1 further comprising a beveled back stopper section on the second connection section of the second insulator sleeve adjacent to the circumferential retaining groove.

7. The flat F-port coaxial connector of claim 1 wherein the tubular contact has an end extending through the first insulator sleeve exteriorly of the connector body.

* * * * *